US005590614A

United States Patent [19]

Murata et al.

[11] Patent Number: 5,590,614

[45] Date of Patent: Jan. 7, 1997

[54] SEWING MACHINE

[75] Inventors: Yoshihiro Murata, Nagoya; Masanori Shibata, Komaki, both of Japan

[73] Assignee: Kabushikikaisha Barudan, Japan

[21] Appl. No.: 504,872

[22] Filed: Jul. 20, 1995

[30] Foreign Application Priority Data

Jul. 20, 1994 [JP] Japan ..... 6-191133

[51] Int. Cl.[6] ..... D05B 29/00

[52] U.S. Cl. ..... 112/237

[58] Field of Search ..... 112/237, 236, 112/235, 239, 238, 240

[56] References Cited

U.S. PATENT DOCUMENTS 4,292,907 10/1981 Gilbride et al. ..... 112/236
5,373,795 12/1994 Kato ..... 112/236

FOREIGN PATENT DOCUMENTS 5-245278A 4/1993 Japan .

*Primary Examiner*—Peter Nerbun
*Attorney, Agent, or Firm*—William A. Drucker

[57] ABSTRACT

This sewing machine is provided with a stop member for stopping the downward movement of the presser foot holder in the case that the cushion piece on the retainer is left out. This stop member is provided with a cushion piece on its upper surface to stop the abutting member provided in the presser foot holder in the shock-absorbed condition. Besides, this stop operation is performed in the condition where a clearance to place cloth is made between the upper surface of the bed and the lower end of the presser foot. As a result, in the normal condition, it is needless to say that the sewing work can be performed without damage of the cloth or without occurrence of big sound, and even in the abnormal condition that the cushion piece employed on the retainer to prevent the occurrence of the noise has been left out, the sewing work can be continuously performed preventing damage of the cloth or occurrence of excessively big sound.

1 Claim, 9 Drawing Sheets

SEWING MACHINE

BACKGROUND OF THE INVENTION

1. Field of the Invention

The present invention relates to a sewing machine, more particularly to a sewing machine having a presser foot for preventing cloth from lifting up when the needle is pulled out of the cloth, which presser foot is adapted to move up and down synchronizing with the up-and-down movement of the needle bar.

2. Description of the Prior Art

As shown in FIG. 12A, a holding frame 11*f* provided above a bed 3*f* is installed with a needle bar 6*f* for moving up and down which has a driven piece 16*f* to receive a driving force from a needle bar lifting mechanism 8*f* and a sewing needle 15*f*. The needle bar 6*f* is attached with a presser foot holder 20*f* for relatively moving up and down which has a presser foot 29*f* attached at its lower end for preventing cloth 65*f* from lifting up when the needle 15*f* is pulled out of the cloth 65*f* and which holder 20*f* is energized downward by a spring 31*f*. On the other hand, a retainer 47*f* is provided for moving up and down along the presser foot holder for controlling the up-and-down movement of the presser foot holder 20*f* by supporting it upward. The retainer 47*f* is provided with a cushion piece 48*f* on its upper surface, and is linked to a driving mechanism 49*f* for driving the retainer 47*f* to reciprocate up and down synchronizing with the up-and-down movement of the needle bar 6*f*. The presser foot holder 20*f* is secured with a guide member 23*f* at its upper end, which is provided with an engaging portion 28*f* for engaging with the retainer 47*f*. Moreover, a needle chuck 14*f* provided at the lower end of the needle bar serves as a lifting member for lifting a contact member 24*f* at the lower end of the presser foot holder 20*f* as the needle bar 6*f* moves upward.

The above-described arrangement operates as follows. When the needle bar 6*f* is caused to move downward by the needle bar lifting mechanism 8*f*, the presser foot holder 20*f* is caused to move downward through the spring 31*f*, and the engaging portion 28*f* is brought into contact with the retainer 47*f* as shown in FIG. 12B. Thereafter, the retainer 47*f* is caused to move downward by the driving mechanism 49*f* synchronizing with the downward movement of the needle bar 6*f*. When the lower end of the presser foot 29*f* reaches to the position just prior to contact with the bed 3*f* as shown in FIG. 12C, the downward movement of the retainer 47*f* is stopped, so that the presser foot 29*f* is retained at that position. In the meantime the needle bar 6*f* moves further downward to become the condition as shown in FIG. 12D. Then, in the process where the needle bar 6*f* moves upward from the condition as shown in FIG. 12D and the needle 15*f* is pulled out of the cloth 65*f*, the presser foot 29 prevents the cloth 65*f* from lifting up. Then, the lifting member 14*f* abuts against with the contact member 24*f* as shown in FIG. 12C. Thereafter, as shown in FIG. 12B, the presser foot holder 20*f* is lifted by the needle bar 6*f* and simultaneously the retainer 47*f* is also moved upward together by the driving mechanism 49*f*. And, as shown in FIG. 12A, when the needle bar 6*f* moves upward to its upper limit, the presser foot holder 20*f* is lifted up, through the engagement of the lifting member 14*f* and contact member 24*f*, to its upper limit higher than the range of the up-and-down movement by the retainer 47*f*, so that a clearance Gf is made between the retainer 47*f* and the engaging portion 28*f* (for instance, see the Kokal tokkyo koho No.5-245278).

According to the above-described arrangement, the presser foot 29*f* can prevent the cloth 65*f* from lifting up when the needle 15*f* is pulled out of the cloth 65*f*, so that smooth sewing is made possible. Moreover, when the needle bar 6*f* has been lifted up, the presser foot 29*f* also can be lifted up to a position above the bed 3*f*, so that it is made possible to traverse the cloth 65*f* freely on the bed 3*f* and the sewing work of free design is made possible. Besides, the downward movement of the presser foot 29*f* is made to stop at the position where the presser foot 29*f* does not abut against the bed 3*f*, so that the cloth 65*f* can be prevented from damage by pressing it to the bed 3*f*.

Moreover, when the needle bar 6*f* has been lifted up as shown in FIG. 12A, a clearance Gf can be formed between the retainer 47*f* and the engaging portion 28*f*, so that in a multi-needle sewing machine (for instance, a multi-needle sewing machine relating to one head of a multi-head sewing machine as known in U.S. Pat. No. 4,531,467), exchange of one needle bar 6*f* of the multineedle bars to another one is made possible by the lateral movement of the holding frame 11*f*. Furthermore, when the engaging portion 28*f* abuts against the retainer 47*f* in spite of the existence of the the clearance Gf as the presser foot holder 20*f* moves downward, the retainer 47*f* can be left previously to start in to move downward slowly by the driving mechanism 49*f*, so that the difference of the speed between the engaging portion 28*f* and the retainer 47*f* is made small and the sound of collision of them can be made small.

Also, even when there is a few difference of speed between the engaging portion 28*f* and retainer 47*f*, collision of them can be absorbed by the cushion piece 48*f*, so that the sound of collision can be made small. In this conventional sewing machine the cushion piece 48*f* plays an important role. But, if the cushion piece 48*f* is left out during the working of the sewing machine as shown in FIG. 12E, the presser foot 29*f* in the downward moving reaches to the lower position, in spite of stopping of the retainer 47*f*, by the thickness of the cushion piece 48*f* in comparison with the normal condition where the cushion piece 48*f* exists in place, and it results in the collision of the lower end of the presser foot 29*f* with the bed 3*f*. Then, the presser foot 29*f* repeatedly collides with the bed due to the high speed operation of the sewing machine, so that the generated big sound surprises the operator, the presser foot 29*f* is damaged, or the cloth 65*f* on the bed 3*f* is damaged. Difficulty in continuing the sewing work results.

SUMMARY OF THE INVENTION

Accordingly, the sewing machine of the present invention is provided in order to resolve the above-described problems of the prior art.

The sewing machine according to the present invention is the one in which:

in a sewing machine having:

a bed for placing cloth;

a holding frame provided above said bed;

a needle bar installed in said holding frame for moving up and down and having a sewing needle attached at its lower end;

a presser foot holder installed in said holding frame for moving up and down, energized downward and having a presser foot attached to its lower end, said presser foot provided for preventing the cloth from lifting up when the needle is pulled out of the cloth;

a retainer provided along said presser foot holder for moving up and down to retain said presser foot holder before the lower end of said presser foot touches the upper surface of the bed, said retainer having a cushion piece on its upper surface;

a driving mechanism to operate synchronizing with the up-and-down movement of said needle bar so that said retainer linked to the driving mechanism may reciprocate up and down synchronizing with the movement of said presser foot holder;

said presser foot holder provided with an engaging portion for engaging with said retainer so that said retainer may cause said presser foot holder to move upward as said retainer moves upward under said engaging portion;

said needle bar provided with a lifting member for lifting said presser foot holder as said needle bar moves upward; and said presser foot holder provided with a contact member for engaging with said lifting member, wherein said engaging portion of said presser foot holder is adapted to separate from said retainer when said needle bar moves upward to its upper limit with the aid of the engagement between said lifting member and contact member, the improvement comprising:

said holding frame provided with a stop member having a cushion piece attached on its upper surface so that the downward movement of said presser foot holder may be stopped when said retainer moves downward in a condition that the cushion piece on the upper surface of said retainer is left out; and said presser foot holder provided with an abutting member for abutting against the upper surface of said stop member, wherein said stop member and abutting member are adapted in the positional relationship in the vertical direction so that a clearance may be made for placing the cloth between the lower end of said presser foot and the upper surface of said bed when said abutting member abuts against said stop member.

The first object of the invention is to provide a sewing machine which is adapted to be capable of sewing smoothly by depressing the lift of the cloth with the presser foot when the needle is pulled out of the cloth.

The second object is to provide a sewing machine which is adapted to make the presser foot also to move upward to a position above the bed as the needle moves upward so that the cloth may traverse freely on the bed.

The third object is to provide a sewing machine which is adapted to stop by the retainer the presser foot moving downward at such position that it does not abut against the bed so as to prevent the cloth from being injured.

The fourth object is to provide a sewing machine which is adapted to cut the linkage between the engaging portion connected to the presser foot and the retainer so as to make a smooth exchange of the needle bars possible.

The fifth object is to provide a sewing machine which is adapted to make the difference small between both speeds of the engaging portion and the retainer when the former abuts against the latter as the presser foot moves downward so as to prevent the sound of the collision from occurring.

The sixth object is to provide a sewing machine which is adapted to absorb, by a cushion piece, a collision caused by a difference between both speeds, if any, of the engaging portion and the retainer in the above-described case so as to make the sound of collision small.

The seventh object is to provide a sewing machine which is adapted to prevent the abnormal big sound of the impact from occurring when the presser foot abuts against the bed, to prevent the presser foot from being damaged, or to prevent the cloth from being injured even when the cushion piece is left out to make a change in the engaging relation between the engaging portion and the retainer.

Other objects and advantages of the invention will become clear from the following description taken in conjunction with the drawings.

DETAILED DESCRIPTION OF THE PREFERRED EMBODIMENT

Figure 1B:
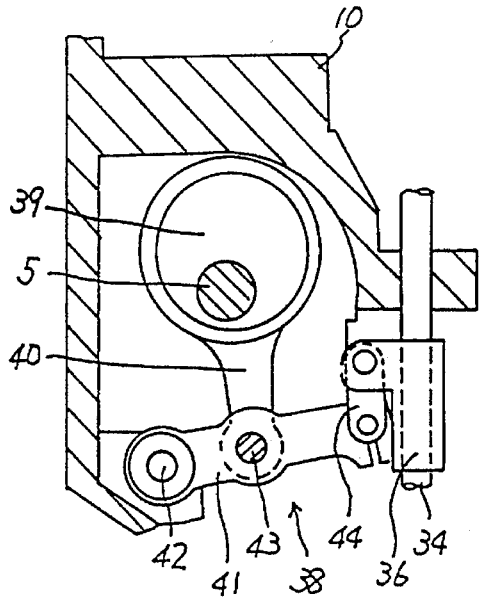
FIG. 1B is a partially sectional view showing a needle bar lifting mechanism.

An embodiment of the present invention will now be explained with reference to the accompanying drawings. Referring to FIG. 1 showing a part of a multi-head sewing machine having a number of sewing machine heads as an example of sewing machines, numeral 1 designates a frame or bridge for supporting a number of sewing machine heads. Numeral 2 designates one of the sewing machine heads provided in the frame 1. Numeral 3 shows the existence of a bed under the sewing machine head 2; that is, a part of a needle plate in the bed. Under the bed 3 is provided a bobbin case *3b*, as well known. Numeral *3a* is a needle hole. Numeral 4 designates a main frame of the sewing machine head, 5 a driving main shaft inserted into the main frame 4, 6 a needle bar for moving up and down, and 7 a cloth presser to prevent the cloth from lifting, which is adapted to move up and down synchronizing with the needle bar 6. Numeral 8 designates a needle bar lifting mechanism to drive the needle bar 6 to move up and down by the rotary motion of the main shaft 5, and 9 a control mechanism to control the operation of the cloth presser 7.

The main frame 4 has a body member 10 secured to the frame 1 and a holding frame 11 mounted for rotating horizontally with bearings 12 on the body member 10. Incidentally, in case this holding frame 11 is adapted not to rotate, it may be integrated to the frame 1. Regarding to the needle bar 6, a plurality of them are installed for moving up and down respectively in the holding frame 11, and they are arranged in line on a circular arc of which center lies on the rotary center of the holding frame 11 so that each of the needle bars 6 may be positioned alternately above on a needle hole 3*a* by the horizontal rotation of the holding frame 11. Numeral 11*a* designates a stop member to stop and receive the cloth presser 7 at its lower limit and 11*c* designates a stop member to stop and receive the needle bar 6 and cloth presser 7 at their upper limit, and each of them is illustrated as an arrangement having cushion pieces 11*b*, 11*d*, for instance, rubber O rings, mounted on the upper and lower sides of the base member integrated to the holding frame 11. Numeral 14 designates a lifting member to lift up the cloth presser 7 also to its upper limit as the needle bar 6 moves upward to its upper limit, and the lifting member 14 is constituted as a needle chuck provided at the lower end of the needle bar 6. The lifting member 14 is provided, on its upper surface, with a cushion piece 14*a*, for instance, a rubber O ring. Numeral 15 designates a sewing needle. A driven piece 16 secured to the upper end of the needle bar 6 is provided for receiving the driving force from the needle bar lifting mechanism 8, and provided with a receptacle 17 for fitting to a driving element in the mechanism 8. Numeral 18 is a detent element receptacle, in which a detent element 19 to stop the rotation of the needle bar 6 is fitted for moving up and down relatively. Incidentally, the detent element 19 is integrated to a member (a base bar to be described later) of the cloth presser 7, while it may be formed as a separate component to be mounted on the holding frame 11.

Figure 5:
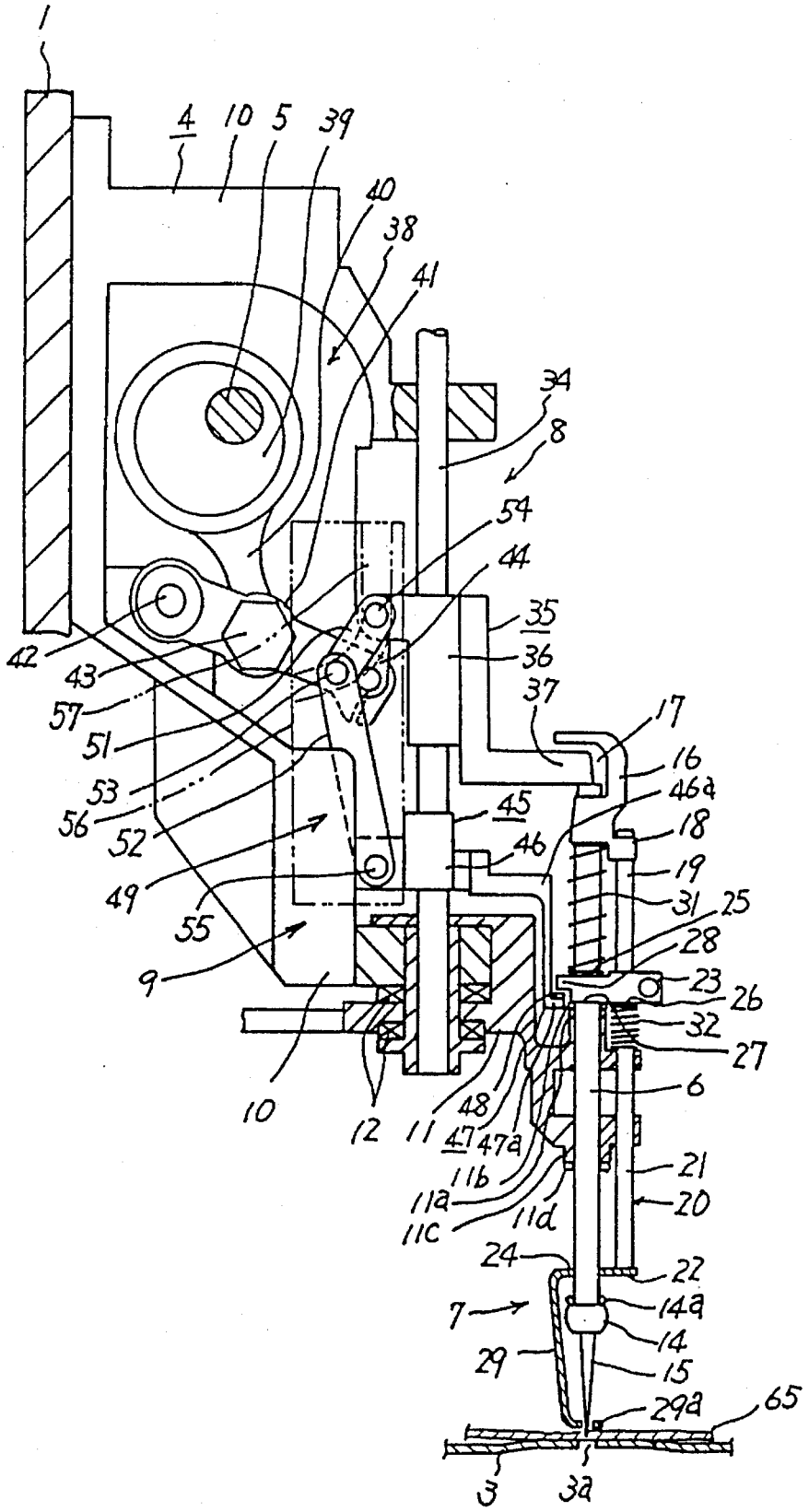
FIG. 5 is a longitudinal sectional view of the sewing machine head In the condition where the presser foot has reached to the lower limit.
Figure 6:
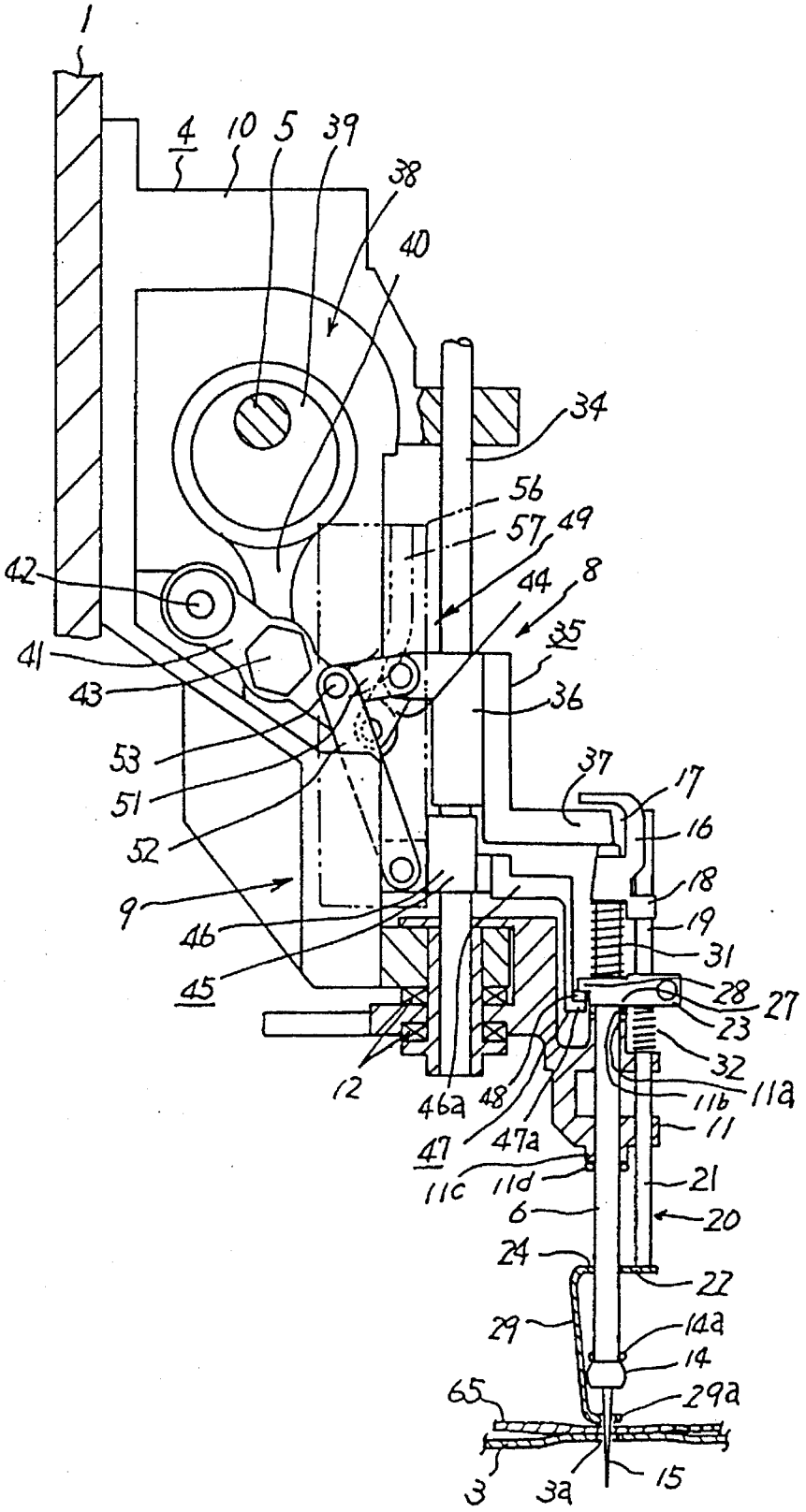
FIG. 6 is a longitudinal sectional view of the sewing machine head in the condition where the needle bar has reached to the lower limit.

Next, the cloth presser 7 will be explained. Numeral 20 designates a presser foot holder, which is illustrated as an arrangement comprising a base bar 21 inserted into the holding frame 11 for moving up and down, a guide member 22 secured to the lower end of the base bar 21, and another guide member 23 provided on the upper portion of it for adjusting the position up and down. The needle bar 6 is inserted into the through holes bored in both guide members 22, 23 so that this presser foot holder 20 may move up and down parallel to the needle bar 6, while another arrangement will be allowed wherein the presser foot holder 20 is installed in the holding frame 11 only for moving up and down parallel to the needle bar 6. Numeral 24 designates a contact member to determine the lower limit of the downward movement of the cloth presser 7 relative to the needle bar 6, which is illustrated as an arrangement composed of a guide member 22. Numerals 25, 26 designate spring seats, which are illustrated as an arrangement composed of a part of the guide member 23. Numeral 27 designates an abutting member to abut against the stop member 11*a*, which is illustrated as an arrangement composed of the edge of a through hole into which the needle bar is inserted on the under surface of the guide member 23. Numeral 28 designates an engaging portion to engage with a retainer to be described later in the control mechanism, and the engaging portion 28 is illustrated as an arrangement provided in the guide member 23. Numeral 29 designates a presser foot provided at the lower end of the presser foot holder 20, and the presser foot 29 is illustrated as an arrangement integrated to the guide member 22, and 29*a* designates a presser toe to prevent the cloth from lifting up by depressing the cloth when the needle is pulled out of the cloth. Next, numeral 31 designates the first spring to lift the needle bar 6 and to energize the cloth presser 7 in the downward direction in the conditions as shown in FIG. 6 to FIG. 5, and the spring 31 is illustrated as an compression spring standing between the driven piece 16 and spring seat 25. Besides, the spring 31 is provided around the needle bar 6 to prevent from jumping out sideward. Numeral 32 designates the second spring to lift the needle bar 6 and cloth presser 7, and the spring 32 is illustrated as a compression spring, which is weaker than the spring 31, standing between the holding frame 11 and spring seat 26. The second spring 32 is provided around the base bar 21, as well as the first spring 31, to prevent from jumping out sideward.

Next, the needle bar lifting mechanism 8 will be explained. Numeral 34 designates a guide bar to guide a lifter to move up and down, which is supported by the body member 10 of the main frame 4 at its lower and upper portions respectively. Numeral 35 designates a needle bar lifter to lift the needle bar 6 or a needle bar drive member to drive a needle bar 6 for moving up and down, which comprises a body member 36 mounted on the guide bar 34 for moving up and down and a needle bar drive 37 secured to the body member 36. Numeral 38 designates a driving mechanism to convert the rotary motion of the main shaft 5 into the lifting motion, which is transferred to the needle bar lifter 35 so as to move up and down, and the driving mechanism 38 is illustrated as a well-known lever crank mechanism. This mechanism 38 comprises an eccentric 39 secured to the main shaft 5, a crank rod 40 adapted to move up and down by driving of the eccentric, a lifting lever 41 of which one end is pivoted on the main frame 4 through a pivot shaft 42, and of which the middle portion is pivotally connected to the crank rod 40 through the shaft member 43, and a link 44 (see FIG. 1B) to connect the free end of the lifting lever 41 to the body member 36. When the main shaft 5 rotates, the lever 41 pitches up and down to move the needle bar lifter 35 up and down along the guide bar 34.

Figure 2:
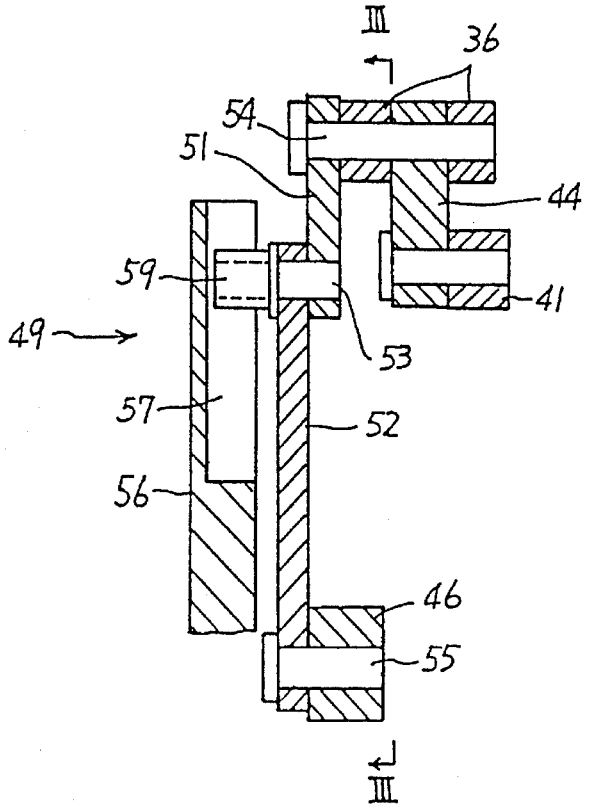
FIG. 2 is a sectional view taken along line II—II of FIG. 1A.

Next, the control mechanism 9 will be explained. Numeral 45 designates a cloth presser lifter to control up-and-down movement of the cloth presser 7 or a cloth presser drive member to drive a cloth presser 7 for moving up and down, which comprises a body member 46 mounted on the guide bar 34 for moving up and down and a linking element 46*a* secured to the body member 46, and the end of the linking element 46*a* is provided with a retainer 47 adapted to retain the presser foot holder 20 to stop its free downward movement. The retainer 47 is illustrated as an arrangement such that a cushion piece 48 (for example, made of polyurethane rubber with hardness 80°–90°, the hardness is the one measured in A-type spring hardness test prescribed in Japan Industrial Standards) is put on a base member 47*a* integrated with the linking element 46*a*. Next, numeral 49 designates a driving mechanism adapted to move the cloth presser lifter 45 up and down following the needle bar lifter 35 at a previously controlled speed. Numerals 51, 52 designate the first and second link elements to transmit the movement of the needle bar lifter 35 to the cloth presser lifter 45. Both link elements are connected through a connecting member 53 for bending mutually; the upper end of the first link element 51 is pivoted on the body member 36 of the needle bar lifter 35 through a connecting element 54, for example, through a pin to pivot the link 44 on the body member 36, and the lower end of the second link element 52 is pivoted on the body member 46 of the cloth presser lifter 45 through a connecting element 55, for example, a pin. Numeral 56 designates a guide body to guide the path of the up-and-down movement of the mutual connection between both link elements 51, 52 so as to change the speed of the up-and-down movement of the cloth presser lifter 45 in comparison with that speed of the needle bar lifter 35. The guide body 56 has a guide portion 57, for example, a groove (see FIG. 2–FIG. 4). Numeral 59 designates a follower to make the connection of the first and second link elements follow the guide portion 57, and the follower 59 is positioned in place so as to move along the guide portion 57. Besides, a roller is used as the follower 59 to make it move smoothly.

Figure 1A:
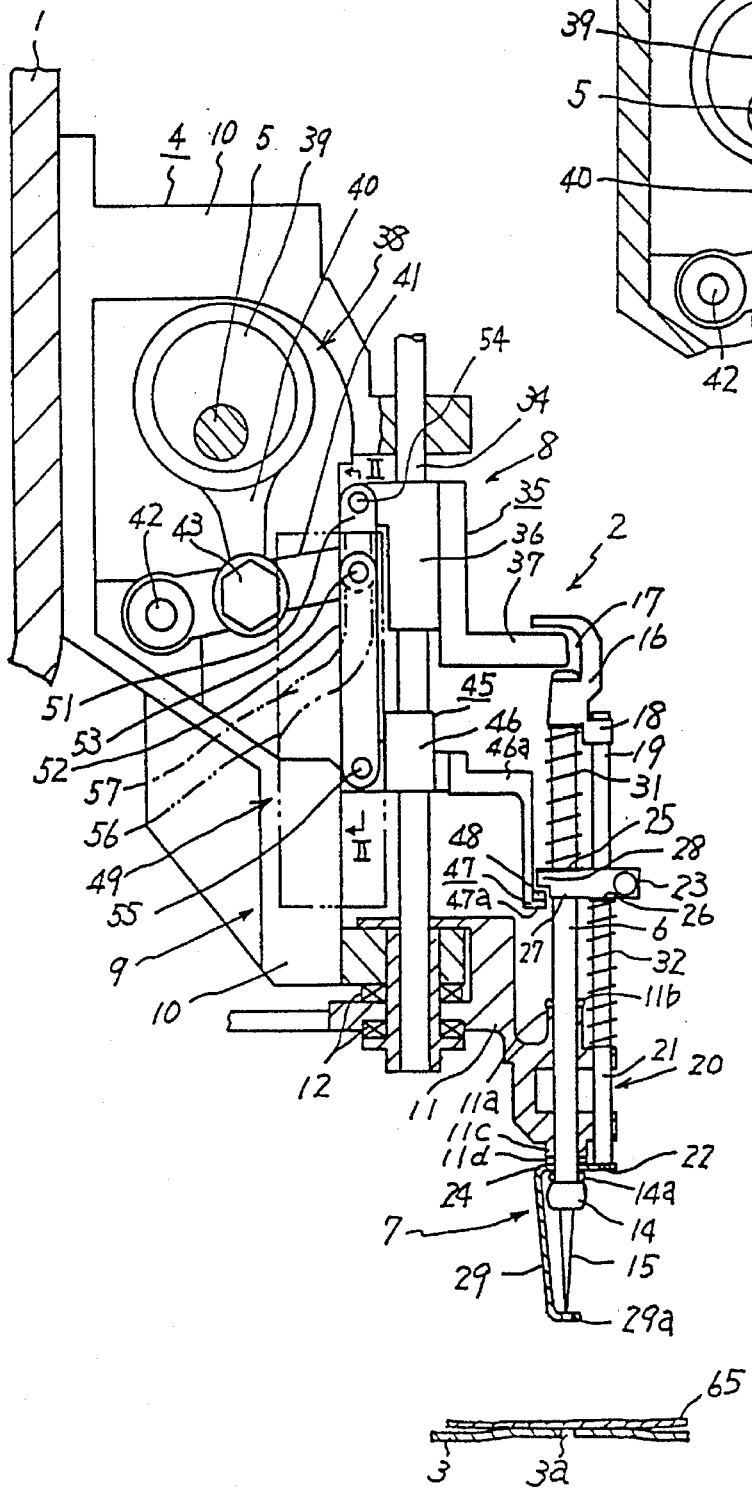
FIG. 1A is a longitudinal sectional view of a sewing machine head without the cover.

Next, the operation of the sewing machine constituted as described above. When the main shaft 5 is rotated, the needle bar lifter 35 moves down from the condition of FIG. 1A, and the needle bar 6 is driven by the needle bar drive 37 to move down from the upper limit in FIG. 1A through the position in FIG. 5 to the lower limit in FIG. 6. At this time, the cloth presser 7 moves down under the control of the control mechanism 9 from the upper limit in FIG. 1A to the lower limit in FIG. 5 and is held there as shown in FIG. 6. Incidentally, the lower limit of the cloth presser 7 is the position suitable for the presser toe 29*a* to prevent the cloth 65 from lifting up when the needle 15 is pulled out of the cloth 65 as described later; for instance, the position that the presser toe 29*a* lies about 1 mm above the upper surface of the needle plate 3. Then, as the needle bar drive 37 moves up, the needle bar 6 moves up through the condition in FIG. 5 to the upper limit as shown in FIG. 1A. In such process, the cloth presser 7 is held at the lower limit as shown in the conditions from FIG. 6 to FIG. 5 to prevent the cloth 65 from rising. As a result, the needle 15 can be smoothly pulled out of the cloth 65 as the needle bar 6 moves up. Thereafter, the cloth presser 7 moves up to the upper limit in FIG. 1 under the control of the control mechanism. Such up-and-down movement of the needle bar 6 and the synchronized up-and-down movement of the cloth presser 7 are repeated, so that the sewing of the cloth 65 can be smoothly performed.

Figure 3A:
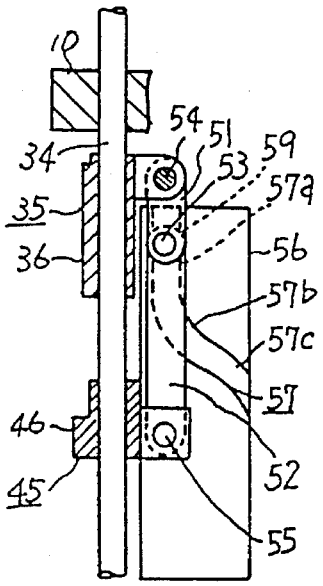
FIG 3A–FIG. 3C are sectional views taken along line III—III of FIG. 2 for illustrating the operation of the driving mechanism (showing the rear view of FIG. 1)
Figure 3B:
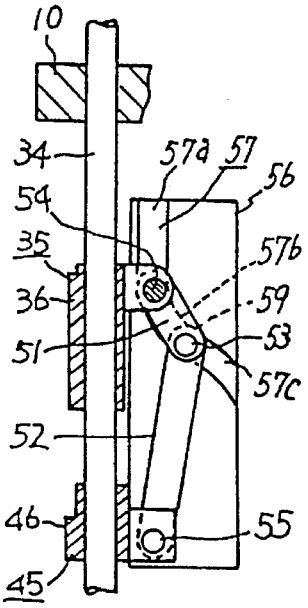
Figure 3C:
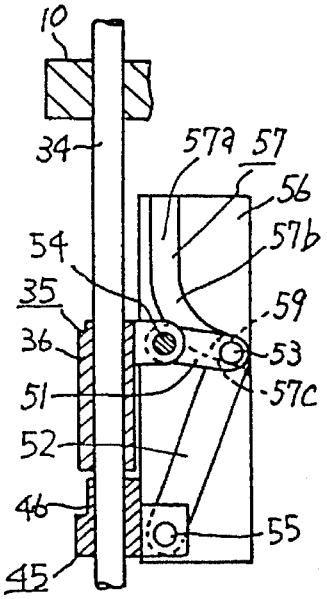
Figure 4:
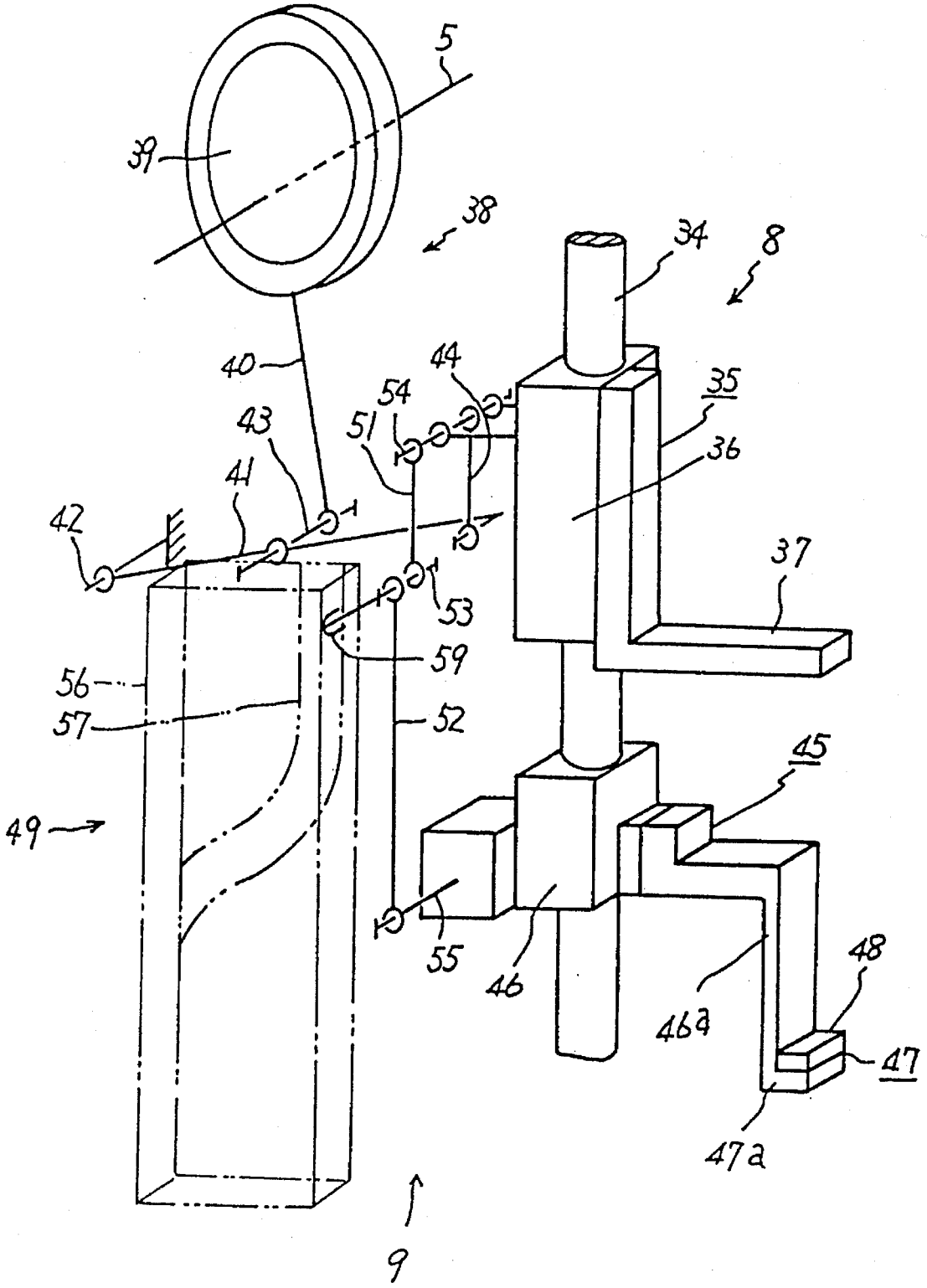
FIG. 4 is a mechanical diagram showing a needle bar lifting mechanism and a control mechanism.

The operational control of the cloth presser 7 will be explained. The cloth presser 7 takes the downward force through the spring 31 as the needle bar 6 moves down. On the other hand, the downward movement of the needle bar lifter 35 is transmitted to the cloth presser lifter 45 through the link elements 51, 52, so that the cloth presser lifter 45 moves downward. In this case, the downward movement of the cloth presser lifter 45 is performed as described below as the follower 59 is guided under the control of the guide body 56. That is, (1) the follower 59 in the guide portion 57 as shown in FIG. 3A moves down in the high speed zone 57*a* which is parallel to the up-and-down direction of the needle bar lifter 35 (the direction of the guide bar 34), so that the cloth presser lifter 45 moves down at the same speed as that of the needle bar lifter 35. (ii) Then, as shown in FIG. 3B, when the follower 59 approaches to the slow speed zone 57*b* on a slant, the first and second link elements 51, 52 bends mutually and the degree of the bending increases gradually, so that the descending speed of the cloth presser lifter 45 becomes smaller than that of the needle bar lifter 35. Besides in this case, the slow speed zone 57*b* is formed In an arc, so that the descending speed of the cloth presser lifter 45 is moderated gradually. (iii) And as shown in FIG. 3C, when the follower 59 reaches to the stop zone 57*c*, only the mutual bending of the link elements 51. 52 becomes large in spite of the downward movement of the needle bar lifter 35, while the movement of the needle bar lifter 35 is not transmitted to the cloth presser lifter 45, so that the cloth presser lifter 45 is stopped to keep the stop condition. Next, in the upward moving process of the needle bar lifter 35, the exactly opposite movement against the downward moving process is performed. (iv) the cloth presser lifter 45 keeps first the stop condition (in the stop zone 57*c*), (v) then, it starts to move up slowly in comparison with the needle bar lifter 35 (in the slow speed zone 57*b*), and performs the upward movement at the same speed as that of the needle bar lifter 35 (in the high speed zone 57*a*). According to the above-described downward and upward movements of the cloth presser lifter 45, the cloth presser 7 performs the downward movement, stop and upward movement as described above under the control of the retainer 47.

Figure 7:
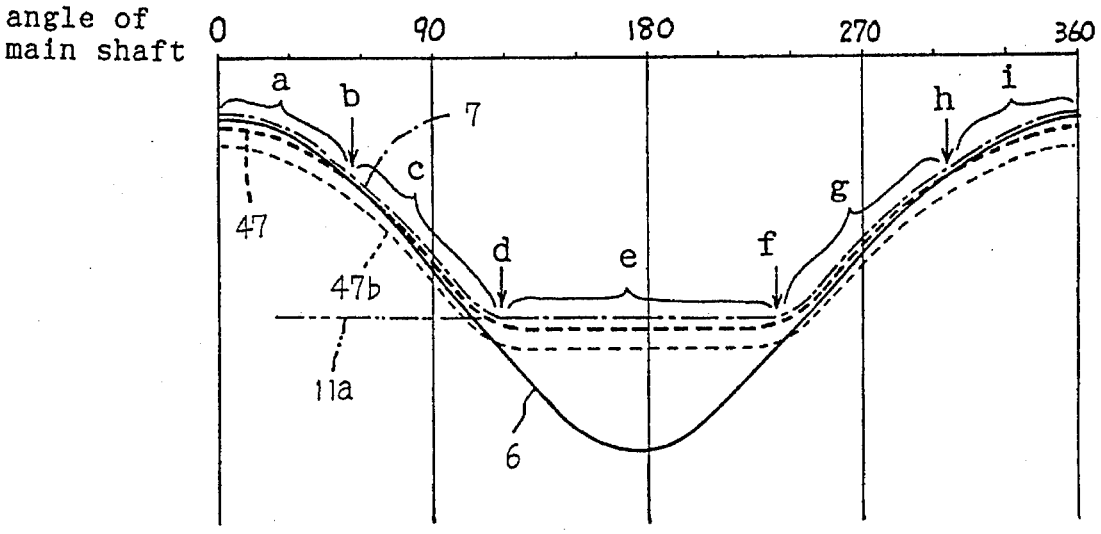
FIG. 7 is a time chart illustrating the operation of the sewing machine head.

The downward and upward movements of the cloth presser 7 resulting from those movements of the needle bar 6 and cloth presser lifter 45 will be further explained according to FIG. 7 and FIG. 8A–FIG. 8E. Incidentally, FIG. 7 shows the relations among the up-and-down movements of the needle bar 6, retainer 47 in the cloth presser lifter 45, stop member 11*a*, and cloth presser 7, where the needle bar 6 is illustrated by the upper surface of the lifting member 14 or the upper edge of the cushion piece 14*a* as a point having the cooperative relation with the cloth presser 7, the retainer 47 by its upper surface or the upper surface of the cushion piece 48 as a point having the linking relation with the cloth presser 7, and the stop member 11*a* by its upper surface or the upper edge of the cushion piece 11*b* as a point having the linking relation with the cloth presser 7. And the cloth presser 7 is illustrated by the under surface of the contact member 24 in the relation with the needle bar 6, by the under surface of the engaging portion 28 in the relation with the retainer 47, and by the under surface of the abutting member 27 in the relation with stop member 11*a*, respectively. Moreover, the dot-dash line showing the cloth presser 7 is naturally to be illustrated one upon another with the solid line showing the needle bar 6 or bold chain line showing the retainer 47, while it makes the figure indistinct, so that the dot-dash line is illustrated on and along to the solid line or bold chain line.

Figures 8A, 8B, 8C, 8D, 8E:
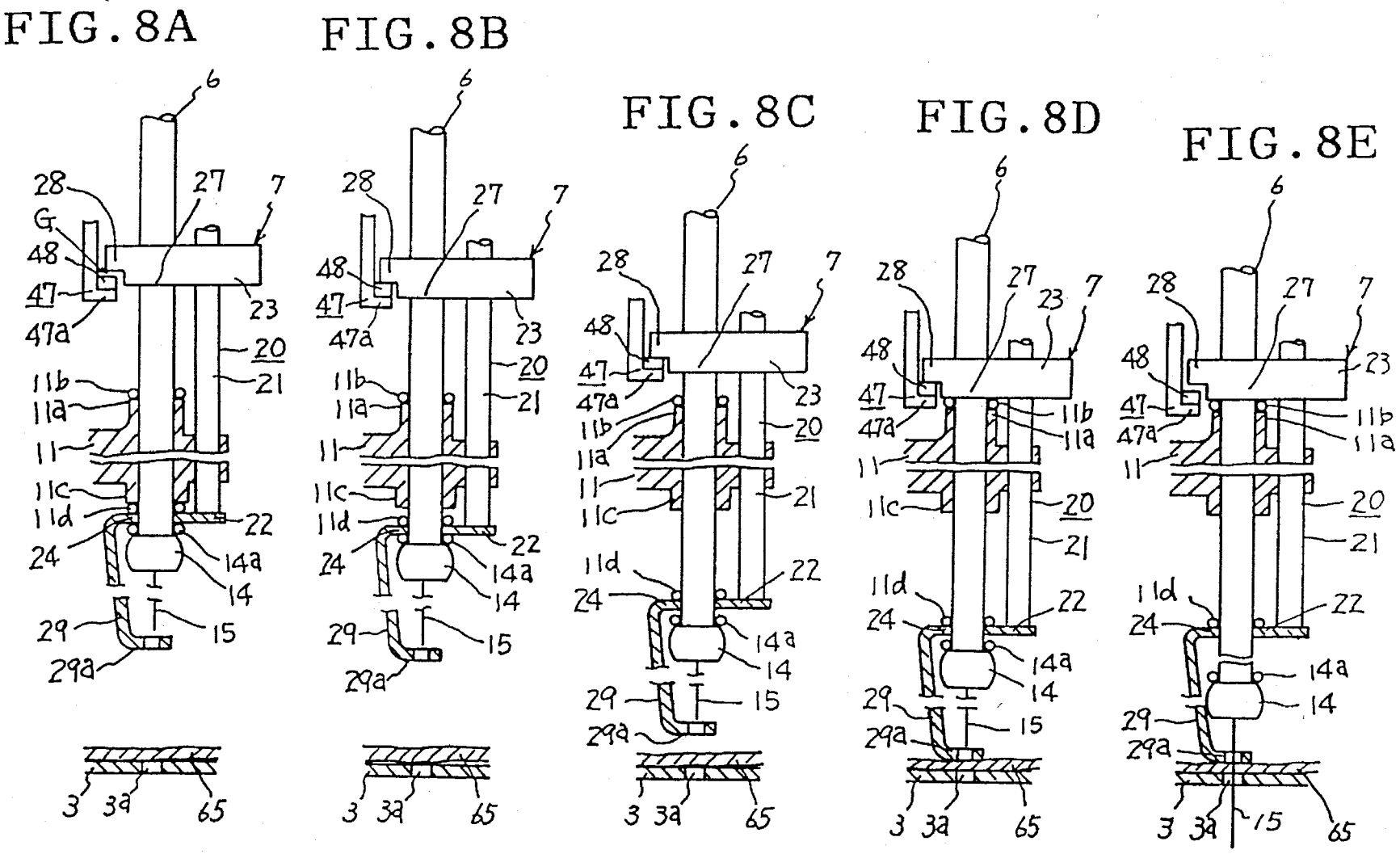
FIG. 8A–FIG. 8E are sectional views illustrating the operation of the sewing machine head in the normal condition.

First, in the section "a" of FIG. 7, the position of the needle bar 6 is relatively higher than that of the retainer 47 as against the cloth presser 7, so that the cloth presser 7 performs the downward movement, as shown in FIG. 8A, integrally with the needle bar 6 in the condition that the contact member 24 of the cloth presser 7 rides on the lifting member 14 of the needle bar 6.

Coming to the point "b" of FIG. 7 (for example, the angle of the main shaft is near 60°; The angle is defined 0° when the needle bar 6 lies on the upper limit.), the position of the needle bar 6 is relatively the same level as that of the retainer 47 as against the cloth presser 7, so that the engaging portion 28 of the cloth presser 7 rides, as shown in FIG. 8B, on the retainer 47. In this case, as obvious because the angle made by the descending curves of the needle bar 6 and retainer 47 is small, the difference between the descending speeds of them is small, so that the engaging portion 28 rides on the retainer 47 in the soft landing condition without impact. Consequently, there is almost no occurrence of the sound of impact. Besides, the existence of the cushion piece 48 prevents the sound of impact from occurring even if there is a few difference of the speeds.

In the section "c" of FIG. 7, the position of the retainer 47 is relatively higher than that of the needle bar 6 as against the cloth presser 7, so that the cloth presser 7 performs the downward movement, as shown in FIG. 8C, integrally with the retainer 47 in the condition that the engaging portion 28 of the cloth presser 7 rides on the retainer 47.

Coming to the point "d" of FIG. 7 (for example, the angle of the main shaft is near 120°), the position of the retainer 47 is relatively the same level as that of the stop member 11*a* as against the cloth presser 7, so that the abutting member 27 of the cloth presser 7 rides, as shown in FIG. 8D, on the stop member 11*a*. In this case, as obvious because the inclination of the descending curve of the retainer 47 is moderated, the descending speed of the cloth presser 7 is small, so that the abutting member 27 rides on the stop member 11*a* in the soft landing condition. Consequently, there is almost no occurrence of the sound of impact. Besides, the existence of the cushion piece 11*b* prevents the sound of Impact from occurring even if the descending speed is large to some extent.

In the section "e" of FIG. 7, the position of the retainer 47 is relatively lower than that of the stop member 11*a* as against the cloth presser 7, so that the cloth presser 7 keeps at rest, as shown in FIG. 8E, in the condition that the abutting member 27 rides on the stop member 11*a*.

Coming to the point "f" of FIG. 7 (the angle of the main shaft is near 240°), the retainer 47 moves upward and the position of the retainer 47 is relatively the same level again as that of the stop member 11*a* as against the cloth presser 7, so that the retainer 47 becomes in the condition that it supports the under side of the engaging portion 28 of the cloth presser 7 in the upward direction. In this case, as obvious because the inclination of the ascending curve of the retainer 47 is moderated, the ascending speed of the retainer 47 is small, so that the retainer 47 abuts against the under surface of the engaging portion 28 in the soft touch condition. Consequently, there is almost no occurrence of the sound of impact. Besides, the existence of the cushion piece 48 prevents the sound of impact from occurring even if the ascending speed is large to some extent. In the section "g" of FIG. 7, the position of the retainer 47 is relatively higher than that of the needle bar 6 as against the cloth presser 7, so that the cloth presser 7 performs the upward movement, as shown in FIG. 8C, integrally with the retainer 47 moving upward in the condition that the engaging portion 28 of the cloth presser 7 is supported by the retainer 47 on the under surface of it in the upward direction.

Coming to the point "h" of FIG. 7 (for example, the angle of the main shaft is near 300°), the ascending speed of the retainer 47 is moderated and the position of the needle bar 6 is relatively the same level as that of the retainer 47 as against the cloth presser 7, so that the contact member 24 of the cloth presser 7 becomes in the condition that it is supported by the lifting member 14 on the under surface of it.

In this case, as obvious because the angle made by the ascending curves of the needle bar 6 and retainer 47 is small, the difference between the ascending speeds of them is small, so that the lifting member 14 abuts against the under surface of the contact member 24 in the soft touch condition. Consequently, there is almost no occurrence of the sound of Impact. Besides, the existence of the cushion piece 14*a* prevents the sound of impact from occurring even if there is a difference of the speeds to some extent.

In the section "i" of FIG. 7, the position of the needle bar 6 is relatively higher than that of the retainer 47 as against the cloth presser 7, so that the cloth presser 7 performs the upward movement, as shown in FIG. 8A, integrally with the needle bar 6 in the condition that the contact member 24 of the cloth presser 7 is lifted by the lifting member 14 of the needle bar 6. When the needle bar 6 moves up to the upper limit, the cloth presser 7 is lifted to the upper limit higher than the range of the up-and-down movement by the retainer 47, the contact member 24 is stopped by the stop member 11*c*, and the upward movements of the needle bar 6 and cloth presser 7 are completed. At this time, a clearance G is made between the engaging portion 28 and the cushion piece 48 of the retainer 47.

Next, in the above-described sewing machine the alternation of the needle bar to perform the sewing with a different thread (color, size, etc.) is carried out by alternating the needle bar 6 just above the needle hole 3*a* to another needle bar by traversing the holding frame 11, for instance, rotating it horizontally when the needle bar 6 and cloth presser 7 move up to the respective upper limits. In this case, there is a clearance between the needle bar drive 37 and the driven element 16 as shown in FIG. 1A, and also there is a clearance G between the engaging portion 28 and the retainer 47 as shown in FIG. 1A and FIG. 8A, so that there is no fear that the needle bar drive 37 interferes with the driven element 16 or the engaging portion 28 interferes with the retainer 47, and the alternation of the needle bars can be smoothly carried out.

Figure 9A:
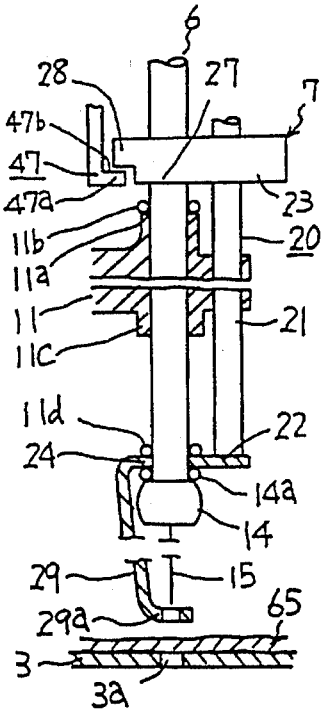
FIG. 9A and FIG. 9B are sectional views illustrating the operation of the sewing machine head in the condition where, the cushion piece is left out.
Figure 9B:
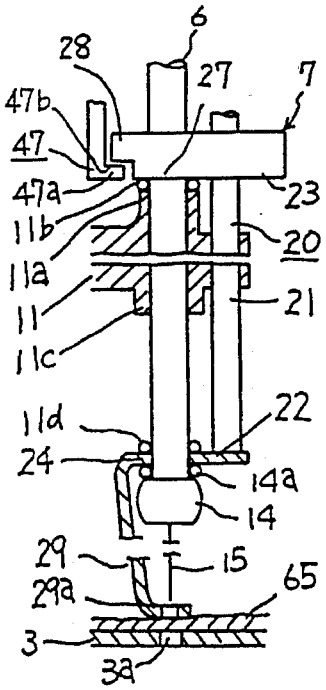

Next, the case will be explained that the cushion piece 48 for the retainer 47 is left out due to fatigue by repeated impacts and other circumstances. In this case, the upper surface 47*b* of the base member 47*a* of the retainer 47 serves as the upper surface of the retainer 47. The upper surface 47*b* of the base member 47*a* is shown in a fine chain line in FIG. 7. As apparent in FIG. 7, the relative position of the upper surface 47*b* of the base member 47*a* with regard to the needle bar 6 and stop member 11*a* lies always on the lower level than either higher position of the needle bar 6 or stop member 11*a*, so that there is no chance that the cloth presser 7 engages with the retainer 47. And in the section where the position of the needle bar 6 is higher than that of the stop member 11*a*, as shown in FIG. 9A, the contact member 24 engages with the lifting member 14 of the needle bar 6 to move up and down together with the needle bar 6. In the section where the position of the stop member 11*a* is higher than that of the needle bar 6, as shown in FIG. 9B, the abutting member 27 is stopped by the stop member 11*a* to keep the condition that a clearance to make the cloth 65 exist is made between the upper surface of the bed 3 and the under surface of the presser toe 29*a* at the lower end of the presser foot 29. In case the condition of FIG. 9A is altered to the condition of FIG. 9B, the abutting member 27 abuts against the stop member 11*a* at the descending speed of the needle bar 6, while the cushion piece 11*b* is provided on the upper side of the stop member 11*a*, so that it can moderate the occurrence of the sound of impact. Moreover, since there is no fear that the presser toe 29*a* abuts against the bed 3, there is also no fear that the presser foot 29 and guide member 22 are deformed and that the cloth 65 is injured.

Next, in the above-described arrangement, the engagement of the lifting member 14 and the contact member 24 in the upward movement of the needle bar 6 may be performed in the earlier time (the point where the angle of the main shaft is small, for Instance, about 250°–260°) In order to do so, it may serve that the upward movement of the retainer 47 by the driving mechanism 49 is performed in the later time in comparison with the above-described embodiment. Also, the keeping of the presser foot in the lower limit may be performed by the retainer 47 Instead of the stop member 11*a*. In order to do so, it may serve that the most lower position in the downward movement of the retainer 47 by the driving mechanism 49 is set in the higher level to some extent in comparison with the above-described embodiment.

Figure 10:
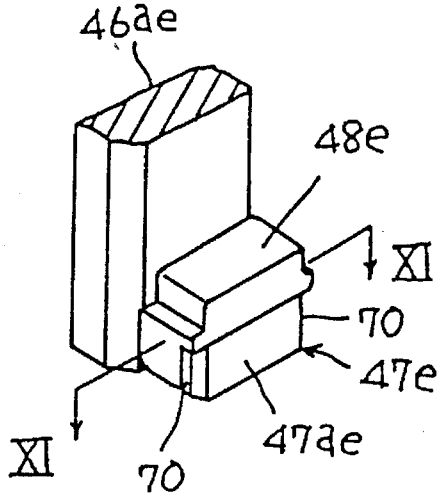
FIG. 10 is a partially perspective view showing another embodiment of the retainer.
Figure 11A:
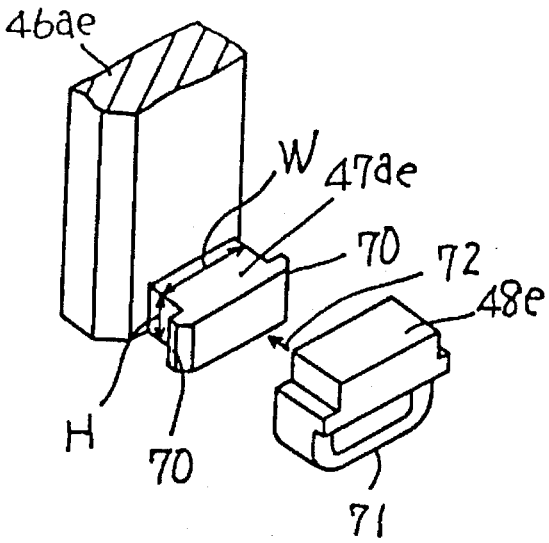
FIG. 11A is an exploded perspective view of the retainer in FIG. 10.
Figure 11B:
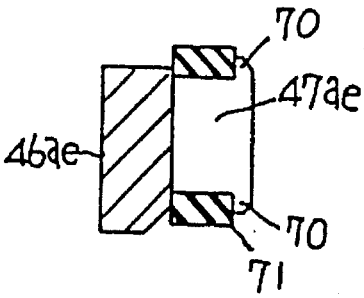
FIG. 11 is a sectional view taken along line XI—XI of FIG. 10.
Figure 12A:
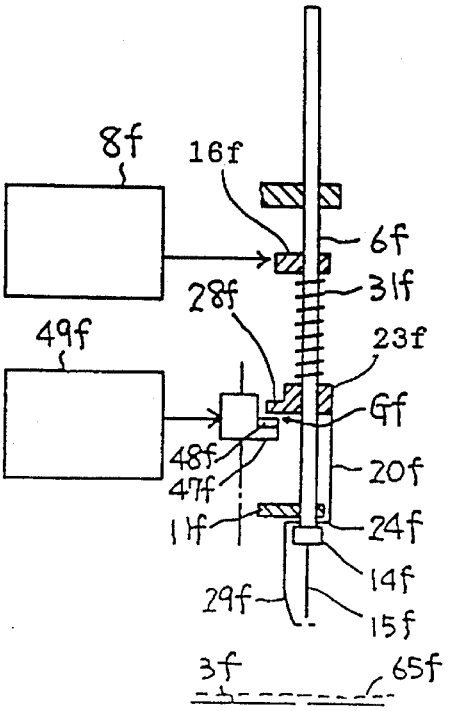
FIG. 12A–12E are sectional views illustrating the operation of a conventional sewing machine.
Figure 12B:
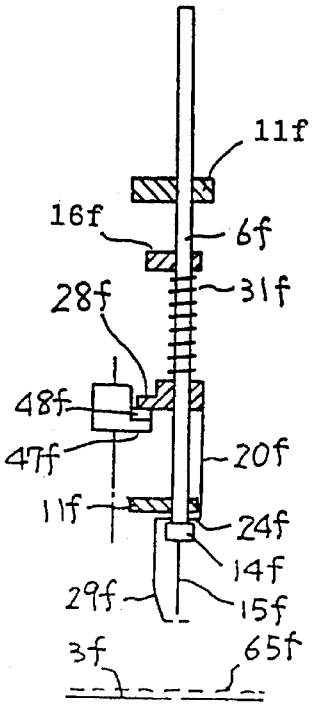
Figure 12C:
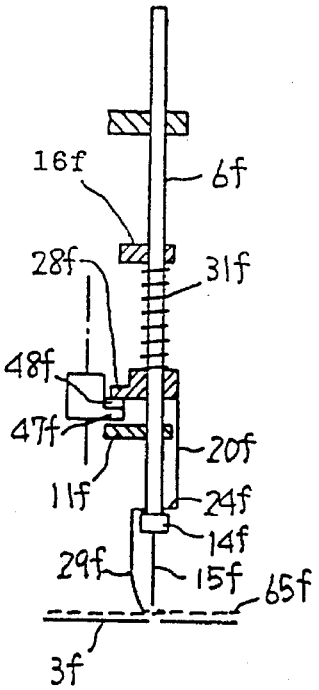
Figure 12D:
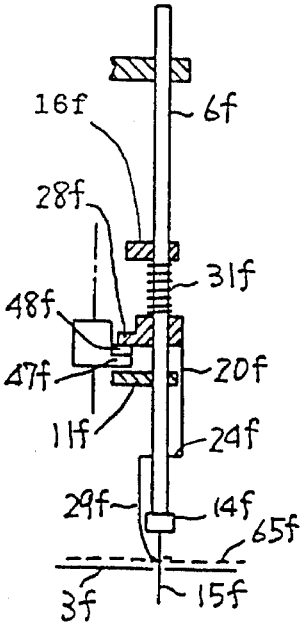
Figure 12E:
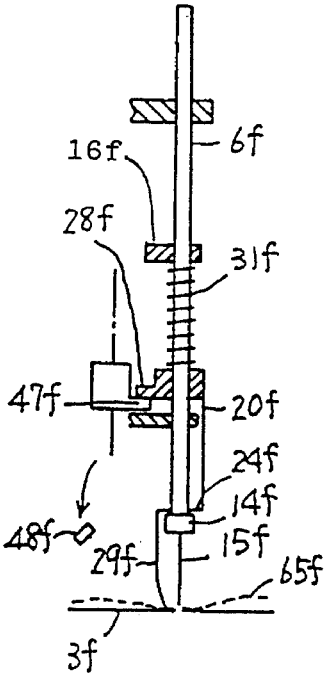

Next, FIG. 10, FIG. 11A and FIG. 11B show another embodiment in which the cushion piece 48*e* has a structure easy to load on and unload from the base member 47*ae* of the retainer 47*e* so that the cushion piece 48*e* may be exchanged easily when it is damaged in the retainer 47*e*. In the FIGURE, numeral 70 designates a stopper provided on the end of the base member 47*ae* and numeral 71 designates a fitting member provided in the cushion piece 48*e*, which is made of elastic material and adapted to fit tightly into the base member 47*ae*. The dimensions of the base member 47*ae*, W and H are, for instance, 6 mm and 3 mm respectively, and the corresponding internal dimensions of the fitting member 71 are, for instance, 5.7 mm and 2.5 mm respectively. In such arrangement, the upper surface of the base member 47*ae* is applied with adhesive and the cushion piece 48*e* is pressed in the arrow direction 72 to the surface. Incidentally, the same references as in the former drawings which are applied with alphabet "e" are used and the explanation to appear duplicate is omitted with regard to the same or equivalent parts as those of the former drawings in view of the function.

According to the present invention, in the normal condition, it is needless to say that the quiet sewing work can be performed, and even in the case that the cushion piece 48 on the retainer 47 has been left out, the sewing work can be continuously performed without damage of the cloth or without damage of the presser foot and in the condition preventing occurrence of excessively big sound owing to the stop of the abutting member 27 by the stop member 11*a*.

What is claimed is:

1. In a sewing machine having:

a bed for placing cloth;

a holding frame provided above said bed;

a needle bar installed in said holding frame for moving up and down and having a sewing needle attached at its lower end;

a presser foot holder installed in said holding frame for moving up and down, means for moving said presser foot holder downward, said presser foot holder having a presser foot attached to its lower end, said presser foot preventing the cloth from lifting up when the needle is pulled out of the cloth;

a retainer provided along said presser foot holder for moving up and down to retain said presser foot holder before the lower end of said presser foot touches the upper surface of the bed, said retainer having a cushion piece on its upper surface;

a driving mechanism for operating in synchronism with the up-and-down movement of said needle bar so that said retainer linked to the driving mechanism may reciprocate up and down in synchronism with the movement of said presser foot holder;

said presser foot holder being provided with an engaging portion for engaging with and separating from said retainer so that said retainer may cause said presser foot holder to move upward as said retainer moves upward under said engaging portion;

said needle bar provided with a lifting member for lifting said presser foot holder as said needle bar moves upward; and said presser foot holder being provided with a contact member for engaging with said lifting member, wherein said engaging portion of said presser foot holder is adapted to separate from said retainer when said needle bar moves upward to its upper limit with the aid of the engagement between said lifting member and contact member, the improvement comprising:

said holding frame being provided with a stop member having a cushion piece attached on its upper surface so that the downward movement of said presser foot holder may be stopped when said retainer moves downward even when the cushion piece on the upper surface of said retainer is not present; and said presser foot holder being provided with an abutting member for abutting against the upper surface of said stop member, wherein said stop member and abutting member are relatively positioned in the vertical direction so that a clearance may be made for placing the cloth between the lower end of said presser foot and the upper surface of said bed when said abutting member abuts against said stop member.

* * * * *